US006561786B2

(12) United States Patent
Ciccarello

(10) Patent No.: US 6,561,786 B2
(45) Date of Patent: May 13, 2003

(54) APPARATUS FOR ROUGHING SURFACES OF CONCRETE CASTED BLOCKS

(75) Inventor: Charles Ciccarello, Brossard (CA)

(73) Assignee: Techo-Bloc Inc., St. Hubert (CA)

( * ) Notice: Subject to any disclaimer, the term of this patent is extended or adjusted under 35 U.S.C. 154(b) by 0 days.

(21) Appl. No.: 10/079,529

(22) Filed: Feb. 22, 2002

(65) Prior Publication Data

US 2002/0145224 A1 Oct. 10, 2002

(30) Foreign Application Priority Data

Apr. 9, 2001 (CA) ..... 2343338

(51) Int. Cl.[7] ..... B28B 11/08
(52) U.S. Cl. ..... 425/343; 425/385; 264/293
(58) Field of Search ..... 425/343, 385, 425/402, 403.1, 472; 249/67, 68; 264/293

(56) References Cited

U.S. PATENT DOCUMENTS

| | | | | | |
|---|---|---|---|---|---|
| 1,229,582 | A | * | 6/1917 | Butterworth | 264/145 |
| 1,672,938 | A | * | 6/1928 | Hervey | 264/162 |
| 2,146,957 | A | | 2/1939 | Jones | |
| 3,754,850 | A | * | 8/1973 | Pate | 425/385 |
| 4,078,038 | A | * | 3/1978 | Gresham, Jr. | 425/385 |
| 4,147,491 | A | * | 4/1979 | Postell, Jr. | 425/385 |
| 4,568,260 | A | * | 2/1986 | Paul et al. | 425/106 |
| 5,133,915 | A | | 7/1992 | Metten et al. | |
| 5,823,736 | A | * | 10/1998 | Matsumura | 249/68 |
| 6,109,906 | A | * | 8/2000 | Castonguay et al. | 425/343 |

FOREIGN PATENT DOCUMENTS

| | | | |
|---|---|---|---|
| CA | 2 127 191 A | | 10/1994 |
| DE | 39 27 601 A | | 3/1991 |
| DE | 41 42 396 | * | 6/1993 |
| DE | 195 48 932 | * | 7/1997 |
| DE | 198 45 174 A | | 4/2000 |
| EP | 0 904 906 A | | 3/1999 |

* cited by examiner

*Primary Examiner*—W. L. Walker
*Assistant Examiner*—Thu Khanh T. Nguyen
(74) *Attorney, Agent, or Firm*—Ogilvy Renault; Guy J. Houle

(57) ABSTRACT

An apparatus and method for roughing surfaces of concrete casted blocks are provided. A horizontally disposed surface roughing device, having impacting elements secured thereto, is driven to impact on blocks supported thereunder on a support table. The support table has a flat support upper surface. Block tilt support pins project from the upper surface at predetermined locations for supporting some of the blocks tilted at a predetermined angle. The block tilt support pins are displaceable from a retracted position below the upper surface to a projecting block tilting position above the upper surface. A displacement mechanism imparts translationary displacement between the impacting elements and the support table to abrade the blocks.

21 Claims, 5 Drawing Sheets

R
30
33
32
30
30
30
C
C
T
11
20A
21A
19A
18A
19A
22A
18A
15A
20B
21B
19B
18A
15B
22B
18B
19B
18B
20C
19C
18C
15C
22C
21C
18C
19C
20D
19C
19D
15D
22D
21D
19D
19C

Fig. 5
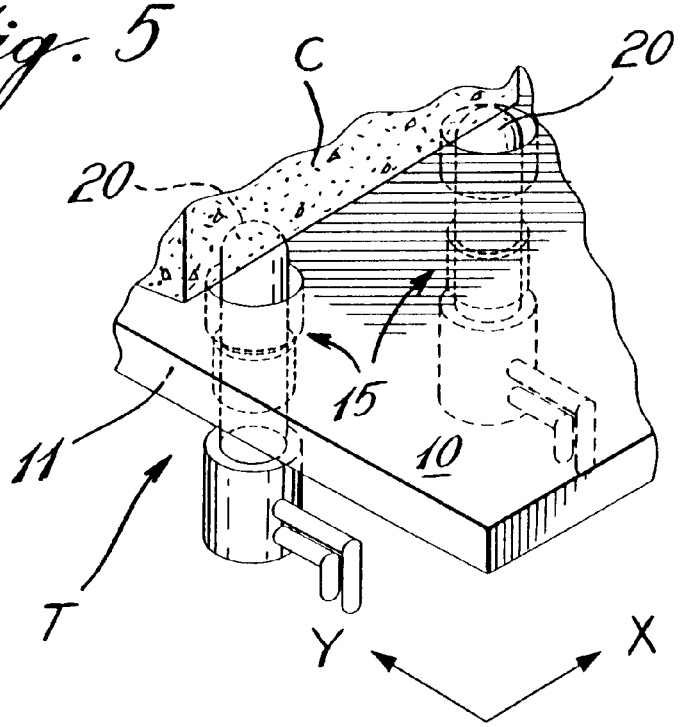
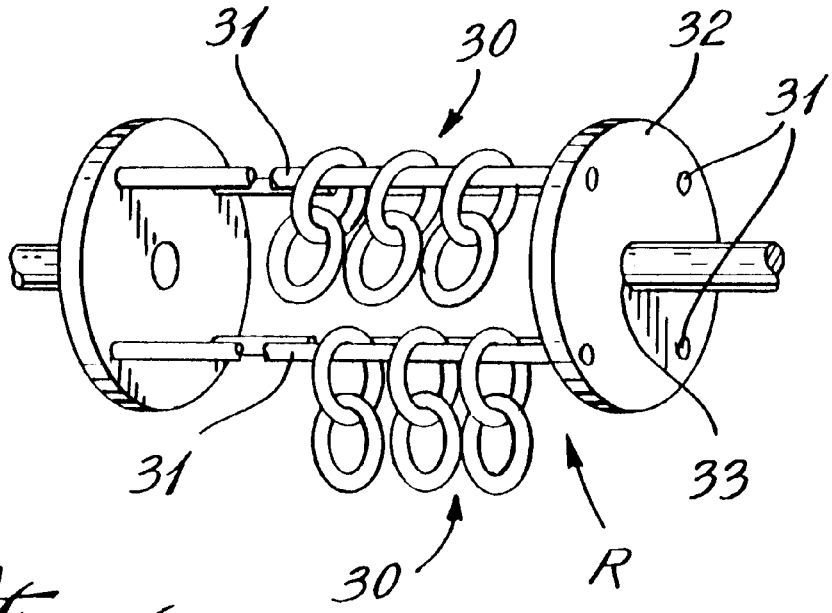
Fig. 6

APPARATUS FOR ROUGHING SURFACES OF CONCRETE CASTED BLOCKS

FIELD OF THE INVENTION

The present invention relates to casted concrete block manufacturing and, more particularly, to an apparatus for roughing blocks to give them a worn or rough appearance.

BACKGROUND OF THE INVENTION

The concrete block casting industry is well developed and is highly automated in its process operations for manufacturing conventional rectangular blocks and the like. The casted blocks have a geometrically uniform rectangular prism configuration in which the surfaces thereof are substantially planar with adjacent surfaces delimited by sharp edges.

It has been known to treat the concrete blocks in order to get a more natural rough look. As antique stone blocks were known to have rounded edges and irregular shaped surfaces, systems have been provided in order to produce such effect on the concrete blocks. However, the equipment used in order to treat these blocks has been incompatible with the fully automated handling equipment used in the other operations of the concrete block producing process. Substantial amount of manual labor and high costs are inherent with the presently used block roughing systems.

For instance, a known method consists in disposing the casted blocks in large tumbling drums. These tumbling drums are rotated about their longitudinal axis in order for the concrete blocks to tumble therein and to collide in order to get damaged. This method, although producing a generally satisfying look, entails substantial costs due to unrepairable damages to concrete blocks. Some blocks are damaged to a point where they may no longer be used and are thus thrown away or recycled. Also, some concrete block patterns may contain blocks of different sizes and these must be stored, which is very time consuming. Also, if a particular one of the blocks in pattern is destroyed more than other blocks, then often the other blocks are no longer useful as a ratio of blocks must be kept. By its nature, the tumbling drum requires frequent repairs. Furthermore, the personnel used for these purposes must deal with a noisy environment due to the tumbling action, and injuries are frequent due to the hazardous operations and handling required thereby. It is difficult to maintain a stable labour force for this work.

U.S. Pat. No. 5,133,915, issued on Jul. 28, 1992 to Metten et al., discloses a surface upon which a plurality of concrete blocks are disposed in a spaced apart relationship. A roller brush translates over the surface of concrete blocks in a reciprocating manner, thereby stripping and roughing the surface of the concrete blocks. Although this method provides substantial advantages over the tumbling drum method described above, it requires that the concrete blocks are spaced apart in order for the sharp edges thereof to be treated. Otherwise, only the top surface would be abraded. Furthermore, the brush type roller provides a relatively uniform abrasion of the concrete blocks, which is not a desired result for use with paving blocks. Finally, as the concrete blocks are spaced apart, the brush can only strike them at a certain velocity in order not to displace them. If they are displaced, they may end up in abutment with one another, whereby only the top surfaces will be abraded, leaving the sharp edges of the block intact. These blocks are usually treated before concrete is cured.

SUMMARY OF THE INVENTION

It is a feature of the present invention to provide a concrete block roughing apparatus which substantially overcomes the disadvantages of the above mentioned prior art.

According to the above features, from a broad aspect, the present invention provides an apparatus for roughing surfaces of concrete casted blocks. The apparatus comprises a horizontally disposed surface roughing device having a plurality of impacting elements secured thereto and driven for impacting on a plurality of concrete casted blocks supported thereunder on a support table. The support table has a flat support upper surface. A plurality of holes extends through the support table. A plurality of support pins are displaceable in associated ones of the boles and projectable above the upper surface at predetermined locations for supporting at least some of the plurality of said blocks tilted at a predetermined angle. Each of the pins is associated with a displaceable mechanism to axially displace the pins from a retracted position below the upper surface of the table to a projecting block tilting position above the upper surface, whereby to tilt selected ones of casted concrete blocks disposed on the support surface. Displacement means is provided to impart translationary displacement between the impacting elements and the support table to abrade the blocks by the impacting elements.

BRIEF DESCRIPTION OF THE DRAWINGS

A preferred embodiment of the present invention as illustrated by examples thereof will now be described with reference to the accompanying drawings in which:

FIG. 5 is a perspective view, partly fragmented, showing a still further embodiment of the present invention;

FIG. 6 is a perspective view, partly fragmented of the roughing tool; and

DESCRIPTION OF PREFERRED EMBODIMENTS

Figure 1:
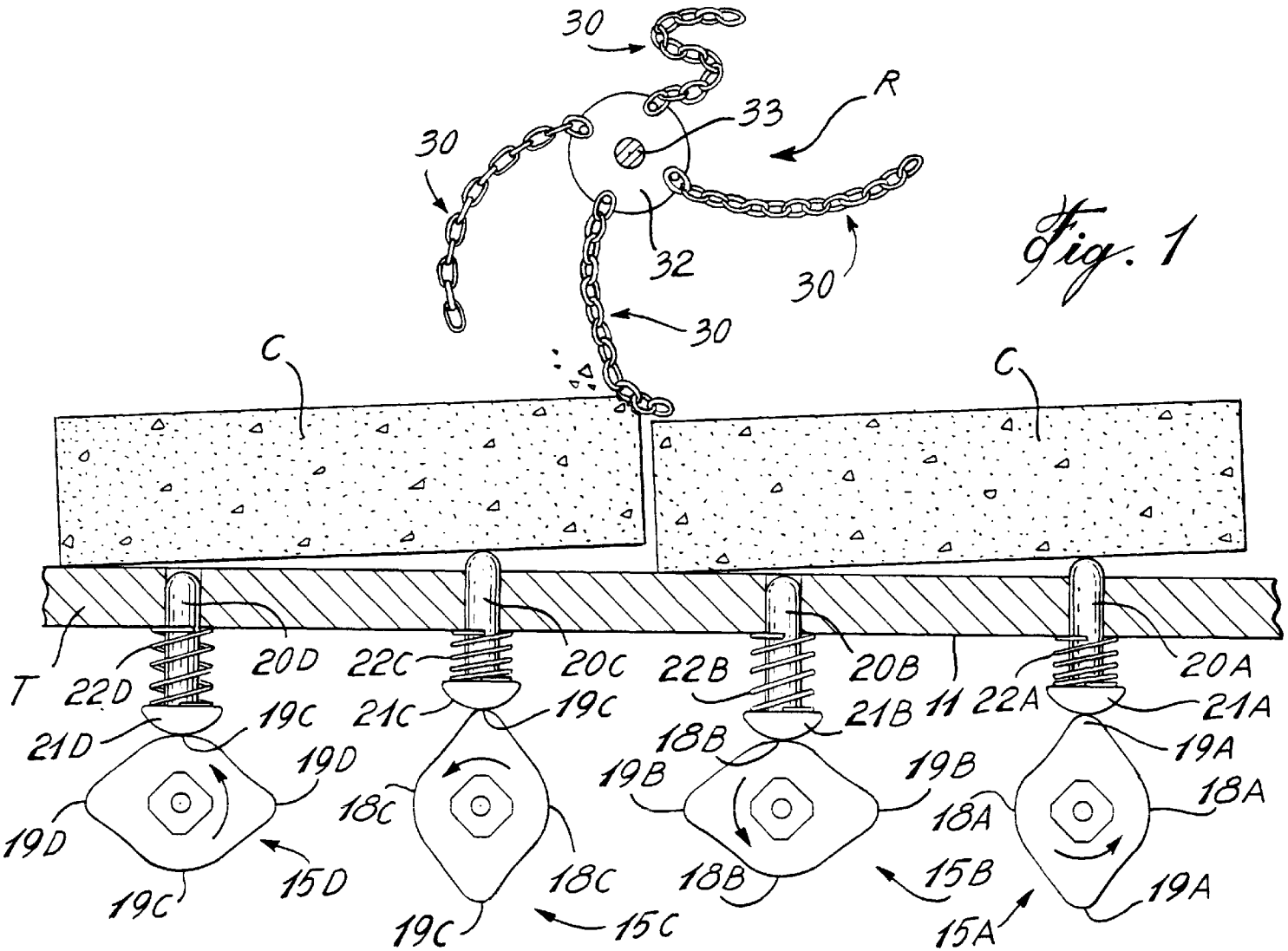
FIG. 1 is a fragmented side elevational and partly sectioned view of an apparatus for roughing concrete blocks in accordance with the present invention.
Figure 2:
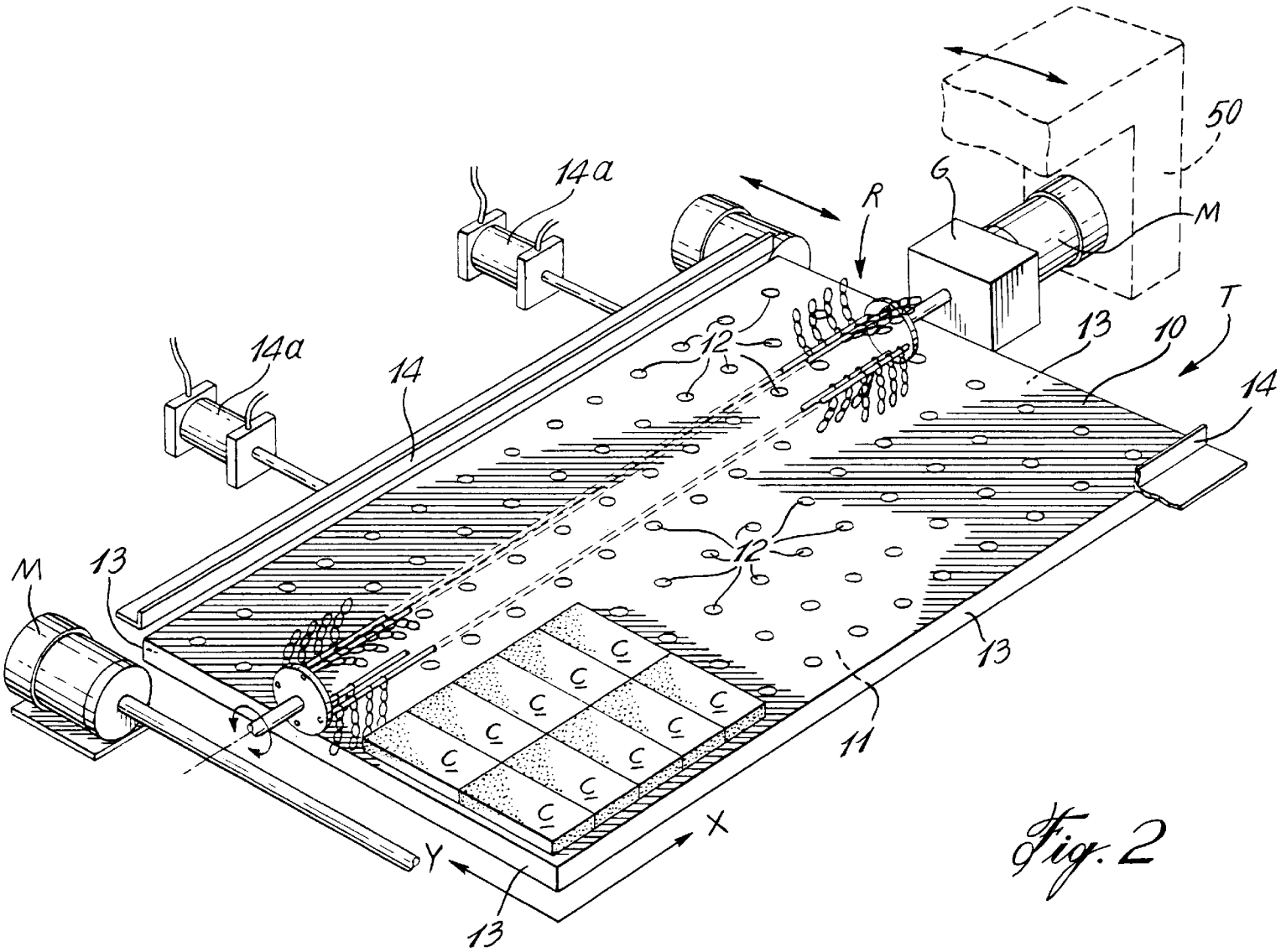
FIG. 2 is a perspective view, partly fragmented, of the apparatus for roughing concrete blocks.

According to the drawings and more particularly to FIG. 1, there is shown an impact rotor roughing tool R and a block tilting table T constructed in accordance with the present invention. Referring now to FIG. 2, the block tilting table T is shown having a generally rectangular shape with a top surface 10 and a bottom surface 11 delimited by side edge surfaces 13, and with concrete blocks C disposed thereon. A plurality of throughbores 12 are equidistantly spaced on the top surface 10, which is substantially planar in order for the concrete blocks to be slid into position thereon. It is observed that the throughbores 12 are spaced in straight parallel columns and provided such that each concrete block C disposed on the table spans over at least two throughbores 12. For instance, each concrete block C, as shown in FIG. 2, may overlap two throughbores 12.

Abutment flanges 14 are disposed over two opposed side edge surfaces 13 of the top surface 10. The abutment flanges 14 are held at free ends of cylinders 14*a*, such as to be displaceable toward the table T, to secure the concrete blocks C disposed thereon. It is pointed out that although cylinders are illustrated in FIG. 2, whether actuated electrically, pneumatically or hydraulically, pistons or the like could also be used for the above described purpose. The abutment flanges 14 ensure that concrete blocks C transferred to the top surface 10 by any automated mechanism will be aligned with respect to the throughbores 12 by abutting thereagainst. The flanges 14 are not in tight contact with the blocks C, thereby allowing the blocks C to be tilted. Furthermore, the flanges 14 are sized not to interfere vertically with the roughing tool R.

Referring now to FIG. 1, the block tilting table T is shown having pins, namely 20*a*, 20*b*, 20*c* and 20*d* amongst others, in each of the throughbores 12. The pins 20 each have a cam follower portion 21 disposed at a lower distal end thereof. Helical tension springs 22 are shown secured to the bottom surface 11 of the table T and exert a pressure on the cam follower portion 21 of the pin 20, to bias the pins 20 downward with respect to the block tilting table T. When one of the helical springs 22 is extended, the pin (as shown by pin 20*b*) is in a retracted position, whereas when one of the helical springs 22 is contracted, the pin (as shown by pin 20*a*) is in a projecting block tilting position. In the retracted position, the pin is completely below the top surface 10 of the table T, whereas, in the projecting block tilting position, the pin extends upward from the top surface 10 to tilt a concrete block C, as shown in FIG. 1.

Figure 3:
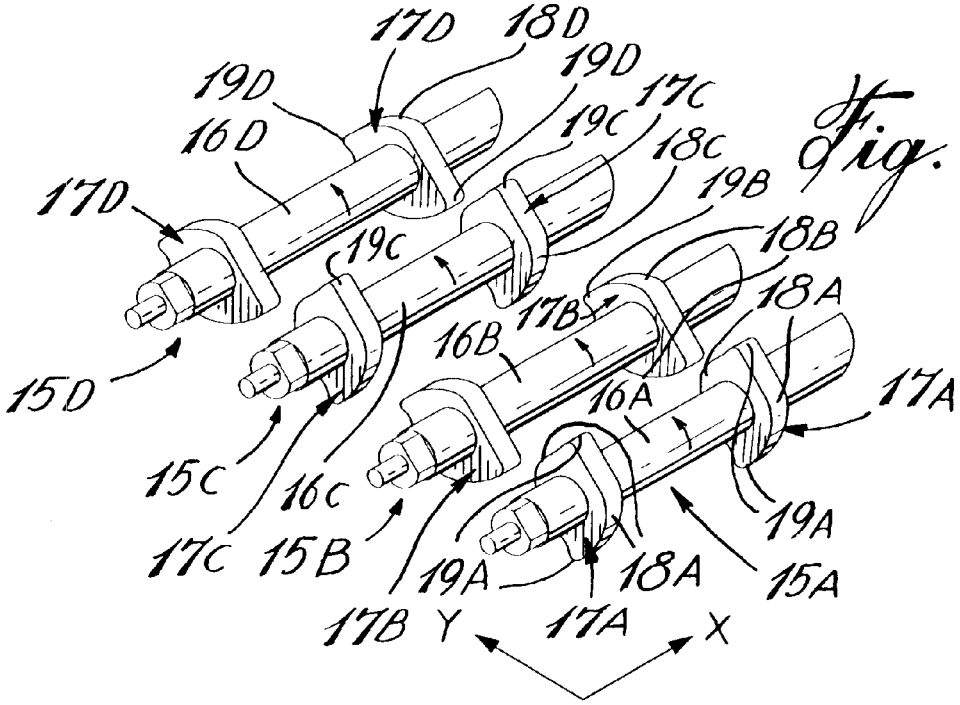
FIG. 3 is a perspective view, partly fragmented, of tilting mechanisms in accordance with the present invention.

In order to actuate the pins between the retracted position and the projecting block tilting position, tilting mechanisms are provided and are generally shown at 15*a*, 15*b*, 15*c* and 15*d* in FIGS. 1 and 3. For reference purposes, sets of corresponding X and Y axes have been provided and will be referred to hereinafter. Each of the tilting mechanisms is constructed similarly. Thus, the tilting mechanism 15*a* will be described and like numerals will designate like elements thereafter.

As best seen in FIG. 3, the tilting mechanism 15A comprises a shaft 16A having a plurality of cams 17A equidistantly spaced thereon. The cams 17A are displaceably secured to the shaft 16A, and are thus positioned so as to each be under one of the throughbore 12.

Referring now to FIGS. 1 and 3, the cams 17 are shown having a pair of pin retracted surfaces 18 and a pair of pin extended surfaces 19. The cam follower portions 21 of the pins 20 are in constant operative contact with the cams 17. When the cam follower is in contact with one of the pin retracted surfaces, as shown by cam follower 21*b* and cam 17*b*, the pin is in the retracted position. On the other hand, when the cam follower is abutting one of the pin extended surfaces, as shown by cam follower 21*a* and cam 17*a*, the pin is in the projecting block tilting position.

Figure 4:
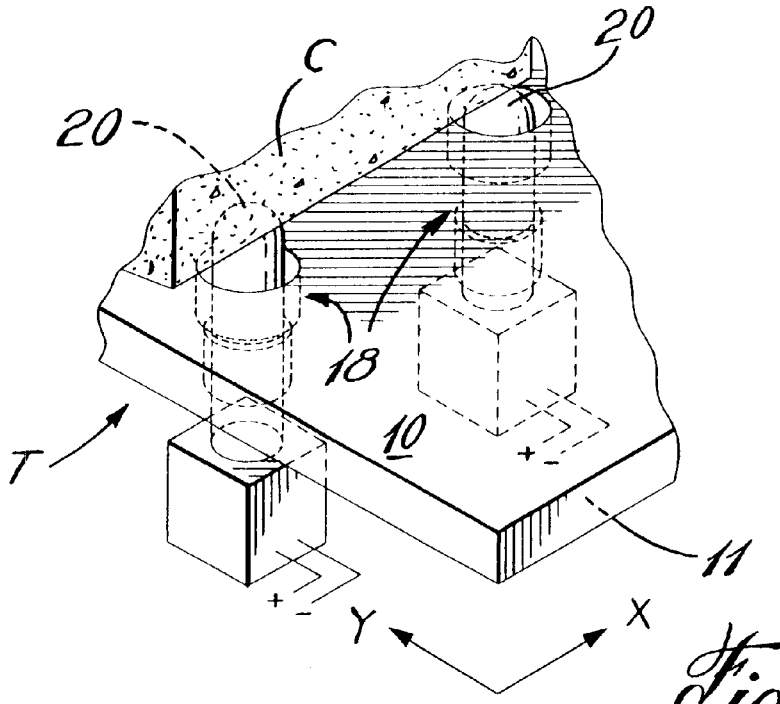
FIG. 4 is a perspective view, partly fragmented, of a tilting mechanism according to another embodiment of the present invention.

When the blocks are disposed on the top surface 10 of the table T, each pin 20 is in the retracted position. Thereafter, alternate tilting mechanisms 15*a* and 15*c* are actuated in concert by an indexing motor, schematically shown at M in FIG. 2, in order to extend upward to the projecting block tilting position, thereby tilting the concrete blocks C disposed on the top surface 10 of the block tilting table T, as depicted in FIG. 1. Consequently, the sharp edges of the concrete blocks are exposed to the roughing tool R. It is observed that the other set of alternating tilting mechanisms, 15*b* and 15*d* are actuated thereafter by another indexing motor M in order to expose the other sharp edges of the concrete blocks C while the tilting mechanisms 15*a* and 15*c* are actuated back to their retracted position. Referring now to FIGS. 4 and 5, alternative embodiments of the present invention are shown whereby the pins 20 are actuated by pneumatic or electrical members.

Returning to FIG. 1, the roughing tool R is generally shown having a cylindrical body R upon which are secured chains 30. As seen with greater detail in FIG. 6, the roughing tool R is comprised of support bars 31 removably connected between a pair of bar attachment disks, one of which is shown at 32. A drive shaft 33 is secured to the disk 32, whereas the other disk 32' is connected to an idle and free to rotate shaft 33'. A plurality of chain link sections 30 are secured to the support bars 31, and are comprised of at least two interconnected loop chain links. The support bars 31 extend through an end loop of each chain link sections 30. By rotating the roughing tool R on its longitudinal axis, the chain link sections 30 will impact on the concrete blocks disposed on the table T. The roughing tool R, although illustrated as translating in the Y axis direction, may translate in both the X axis and Y axis direction or at an angle therebetween by displacing mechanism 50. In the Y axis direction, the roughing tool R translates to strike successive rows of concrete blocks C each having a sharp edge exposed as explained above. Once the roughing tool R reaches an end of the table T, it may translate backwards in order to strike the opposing edges of the concrete blocks which have been lifted to be exposed, in which case the roughing tool R rotates in an opposed direction by being driven by a reciprocating gear coupling G and motor, as shown schematically in FIG. 2.

Figure 7:
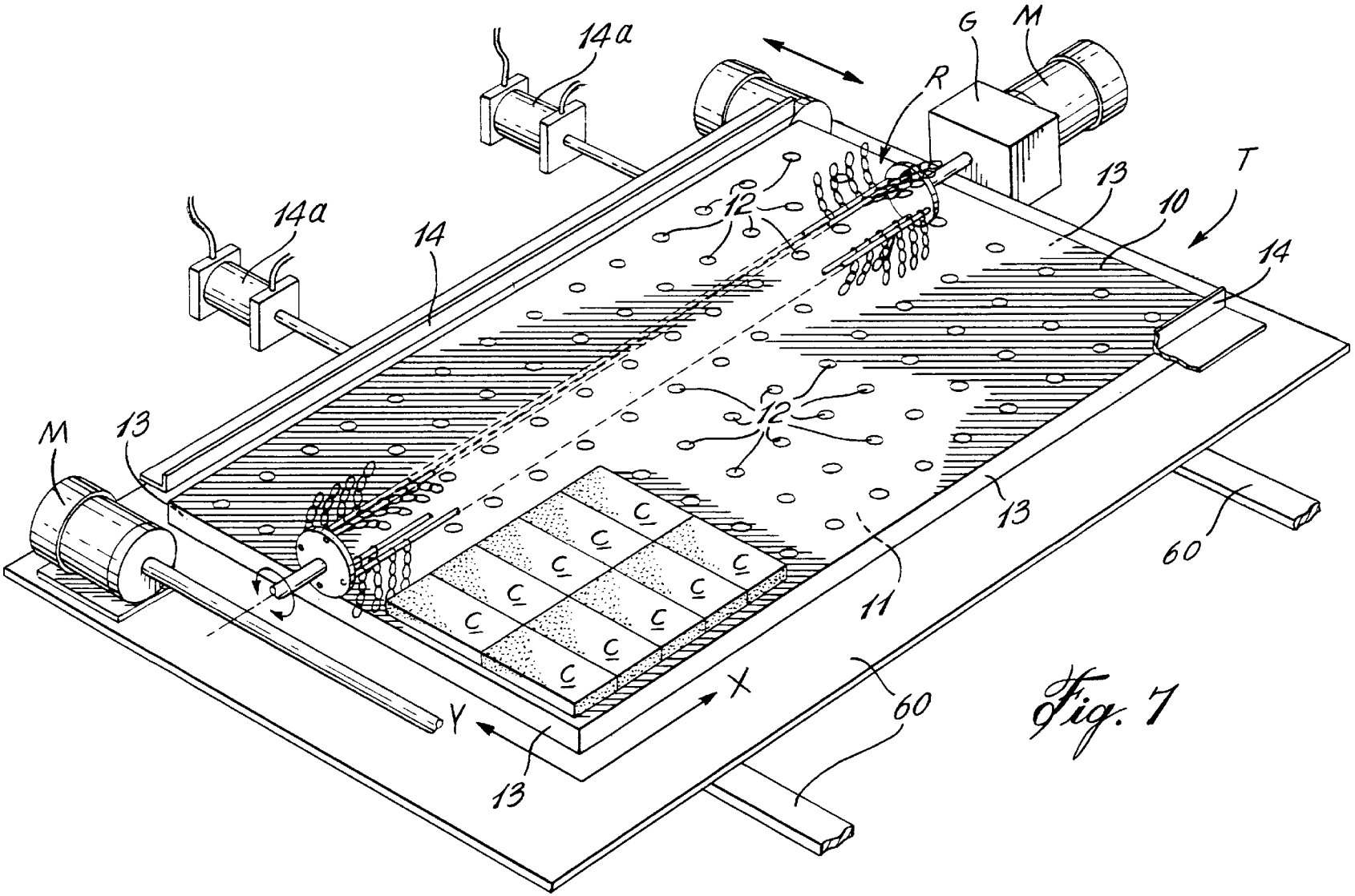
FIG. 7 is a perspective view, partly fragmented, of another embodiment of the roughing tool.

It has also been thought to provide guides and drive mechanisms for displacing the table T instead of the roughing tool R, as shown at 60 in FIG. 7. In such a case, the table T could be rotatable in order for the chain link sections 30 of the roughing tool R to strike the concrete blocks C disposed on a table at an angle.

It is pointed out that the concrete blocks C may be positioned on the tilting table T such as to overlap a pair of throughbores 12 on their width. For instance, the concrete blocks illustrated in FIG. 2 may be transferred after being treated thereon to another table which will expose their longitudinal edges, whereby all four edges of a top surface of the concrete blocks will be roughened. Also, varying patterns of concrete blocks may be disposed on the tilting table T at a same time.

The roughing tool R may be actuated according to a predetermined velocity of rotation. Consequently, various levels of intensity may be provided to the roughing tool R, whereby various levels of abrasion as achieved on the concrete blocks C to chip or scratch the blocks. The tool R may also reciprocate as it rotates. The simplicity of the above described invention allows for a substantial saving in the labor used in order to execute the maneuvers required by the methods of the prior art. It is readily understood how the use of the above described invention may be fully automated. Furthermore, the resulting abrasion on the concrete blocks is relatively consistent according to the intensity of the roughing tool R. However, the movement of the chains 30 of the roughing tool R is not controlled and thus random patterns of abrasion are provided on the concrete blocks C. The above described system is space efficient as the concrete blocks C are disposed in an optimal manner. The only element of the above described invention subject to impacts are the chains 30, whereby the repair maintenance costs remain low relatively to the prior art. It is pointed out that the chains 30 are of a material harder than the concrete blocks C, which may be bricks, paving stones, retaining wall blocks or masonry stones. The production output is continuous as the timing and intensity of the operation may be controlled.

It is within the ambit of the present invention to cover any obvious modifications of the embodiments described herein, provided such modifications fall within the scope of the appended claims.

What is claimed is:

1. An apparatus for roughing surfaces of concrete casted blocks, said apparatus comprising a horizontally disposed surface roughing device having a plurality of impacting elements secured thereto and driven for impacting on a plurality of concrete casted blocks supported thereunder on a support table, said support table having a flat support upper surface, a plurality of holes extending through said support table, a plurality of support pins, each pin is displaceable in each of said holes and projectable above said upper surface at predetermined locations for supporting at least some of said plurality of said blocks tilted at a predetermined angle, each said pin being associated with a displaceable mechanism to axially displace said pins from a retracted position below said upper surface to a projecting block tilting position above said upper surface to tilt selected ones of casted concrete blocks disposed on said support surface, and displacement means to impart translationary displacement between said impacting elements and said support table to abrade said blocks by said impacting elements.

2. An apparatus as claimed in claim 1, wherein said surface roughing device is an elongated impact rotor, said rotor being supported horizontally and having a drive shaft at one end thereof, a motor being connected to said drive shaft to impart axial rotation to said rotor about the central longitudinal axis thereof, and said plurality of impacting elements being secured along a working section of said rotor, said impacting elements being flexible and constructed of material having a hardness greater than that of said concrete, said impacting elements being dimensioned to abrade or chip said concrete blocks when impacted thereon by rotation of said drive shaft.

3. An apparatus as claimed in claim 2, wherein said motor is a variable speed electric motor.

4. An apparatus as claimed in claim 1, wherein said impacting elements are chain link sections.

5. An apparatus as claimed in claim 4, wherein said chain link sections are secured to one or more support bars connected between a pair of bar attachment disks, said drive shaft being secured to one of said disk, the other of said disk having an idle shaft connected thereto.

6. An apparatus as claimed in claim 5, wherein said chain link sections have at least two interconnected loop chain links, each said support bars extending through an end loop of a plurality of said chain link sections, said support bars being removably connected to said bar attachment disks.

7. An apparatus as claimed in claim 2, wherein said motor is connected to said drive shaft through a reciprocating gear coupling to impart an axial reciprocating motion to said elongated impact rotor.

8. An apparatus as claimed in claim 1, wherein said displacement means comprises a guide and drive mechanism for displacing said support table under said surface roughing device in a guided manner and at a predetermined speed.

9. An apparatus as claimed in claim 1, wherein said support table is rotatably displaceable to a desired position in a horizontal plane by motorized drive means.

10. An apparatus as claimed in claim 1, wherein said displaceable mechanism comprises a plurality of cams secured to a plurality of rotatable shafts, each cam having an outer pin biasing surface in contact with a cam follower head of an associate one of said support pins, said support pins being held captive in its associated hole.

11. An apparatus as claimed in claim 10, wherein said support pins are spring biased against said cams by spring means.

12. An apparatus as claimed in claim 11, wherein said spring means is a helical spring disposed about each said support pins, said helical spring being secured at one end to a lower surface of said table and its other end abutting against a rear abutment surface of said cam follower head, whereby said cam follower head is engaged against said outer pin biasing surface of its associated cam.

13. An apparatus as claimed in claim 10, wherein each said cams are shaped to define a pin retracted support surface and a pin projecting biasing surface, said pin projecting biasing surface being spaced from a central longitudinal axis of its associated rotatable shaft at a distance sufficient to cause its associated support pin to project above said upper surface of said table to said projecting block tilting position.

14. An apparatus as claimed in claim 13, wherein said holes in said table are disposed at predetermined intervals along straight parallel columns, there being a plurality of columns in said table, said rotatable shaft and cams secured thereto being supported under said table in alignment with said columns.

15. An apparatus as claimed in claim 14, wherein said cams are displaceably secured to said rotatable shafts at predetermined positions.

16. An apparatus as claimed in claim 13, wherein said cams are symmetrically shaped to define opposed pin retracted support surfaces and opposed transverse pin projecting biasing surfaces.

17. An apparatus as claimed in claim 14, wherein said rotatable shafts are secured to a drive indexing motor by an interconnected linkage whereby said shaft may be rotated one quarter turn to project or retract said pins.

18. An apparatus as claimed in claim 17, wherein a first group of shafts are connected to a first indexing motor and a second group is connected to a second indexing motor.

19. An apparatus as claimed in claim 1, wherein there is further provided guide means for positioning concrete casted blocks in side-by-side and end-to-end relationship over a predetermined area of said table.

20. An apparatus as claimed in claim 1, wherein said displaceable mechanism is a pneumatically operated member associated with each said pin.

21. An apparatus as claimed in claim 1, wherein said displaceable mechanism is an electrically operated member associated with each said pin.

* * * * *